US007673563B2

(12) United States Patent
Mutschall

(10) Patent No.: US 7,673,563 B2
(45) Date of Patent: Mar. 9, 2010

(54) SHEET-TRANSPORTING APPARATUS

(75) Inventor: Stefan Mutschall, Östringen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 462 days.

(21) Appl. No.: 11/708,398

(22) Filed: Feb. 20, 2007

(65) Prior Publication Data

US 2007/0199465 A1 Aug. 30, 2007

(30) Foreign Application Priority Data

Feb. 20, 2006 (DE) ..... 10 2006 007 725

(51) Int. Cl.
*B41F 1/30* (2006.01)

(52) U.S. Cl. ..... 101/408; 101/409; 271/206

(58) Field of Classification Search ..... 271/82, 271/204, 205, 206, 277; 101/246, 408, 409, 101/415.1
See application file for complete search history.

(56) References Cited

U.S. PATENT DOCUMENTS 2,906,204 A * 9/1959 Luehrs ..... 101/409
3,536,321 A * 10/1970 Straube ..... 271/277
3,650,211 A 3/1972 Nentwich
4,718,342 A * 1/1988 Raab et al. ..... 101/409
4,718,343 A * 1/1988 Gensheimer et al. ..... 101/409
4,719,854 A 1/1988 Rüger et al.
4,846,061 A 7/1989 Jeschke et al.
6,263,794 B1 * 7/2001 Haupenthal ..... 101/409

FOREIGN PATENT DOCUMENTS

| | | |
|---|---|---|
| DE | 1 908 181 | 11/1970 |
| DE | 1 761 308 | 5/1971 |
| DE | 35 29 612 A1 | 2/1987 |
| DE | 39 35 219 C1 | 2/1991 |
| DE | 43 21 850 A1 | 1/1995 |
| DE | 36 44 484 A1 | 7/1998 |
| DE | 20 2005 015 009 U1 | 2/2006 |

* cited by examiner

*Primary Examiner*—Ren Yan
(74) *Attorney, Agent, or Firm*—Laurence A. Greenberg; Werner H. Stemer; Ralph E. Locher

(57) ABSTRACT

In the case of a sheet-transporting gripper configuration in a sheet-processing machine, e.g. printing machine, it is provided that a low-mass gripper housing contains thin side walls enclosing a gripper shaft such that imaginary extensions of leaf springs provided intersect at a point on a straight line which passes through gripper tips and a gripper-shaft axis. The point of intersection is located on the far side of the gripper-shaft axis, as seen from the gripper tips.

3 Claims, 3 Drawing Sheets

SHEET-TRANSPORTING APPARATUS

CROSS-REFERENCE TO RELATED APPLICATION

This application claims the priority, under 35 U.S.C. §119, of German application DE 10 2006 007 725.3, filed Feb. 20, 2006; the prior application is herewith incorporated by reference in its entirety.

BACKGROUND OF THE INVENTION

Field of the Invention

The invention relates to a sheet-transporting gripper in a sheet-processing machine, in particular a printing machine.

Published, non-prosecuted German patent application DE 35 29 612 A1, corresponding to U.S. Pat. No. 4,719,854, discloses, for example, a sheet-transporting gripper configuration provided in a cylindrical channel of a sheet-transporting cylinder. The gripper configuration has a gripper finger which is mounted on a pivotable shaft and interacts with a cylinder-mounted gripper support. In order to provide for play-free and thus displacement-free mounting, the gripper finger is fastened on a gripper shaft by two leaf springs and a clamping component. Imaginary extensions of the two leaf springs intersect with the axis of the gripper shaft.

This known gripper configuration gives rise to a relatively high mass moment of inertia which, at high machine speeds, may lead to so-called "rebounding". That is to say reliable gripper closure can only be achieved once the gripper tip has sprung back one or more times from the gripper support.

SUMMARY OF THE INVENTION

It is accordingly an object of the invention to provide a sheet-transporting apparatus which overcomes the above-mentioned disadvantages of the prior art devices of this general type, which, as far as possible, is free of play and has a low mass moment of inertia.

With the foregoing and other objects in view there is provided, in accordance with the invention, an apparatus for transporting sheets in a sheet-processing machine. The apparatus contains a gripper support, a gripper shaft, and a gripper pivotably mounted on the gripper shaft and has a gripper tip interacting with the gripper support. Leaf springs are provided for articulating the gripper tip about the gripper shaft. The leaf springs is disposed such that respective imaginary extensions of the leaf springs intersect at a point on a straight line passing through the gripper tip and a center axis of the gripper shaft. The point is located on a far side of the center axis, as seen from the gripper tip.

A particular advantage of the invention is the fact that the leaf springs of the gripper are disposed such that imaginary extensions of the leaf springs intersect at a point on a region of a straight line which passes through the gripper tip and the axis of the gripper shaft. The region of the straight line is located on the far side of the stretch between the gripper tip and the gripper-shaft axis. This gives rise to a virtual point of rotation for the gripper tip at this point relative to the gripper shaft. However, since it is additionally the case with this configuration that there is a only a slight change in the distance between this point and the point at which the gripper tip meets up with the gripper support in the event of "overpressing", the result is just a very small amount of tolerable gripper shifting. A measure provided for adjusting this point can reduce the "shifting" to more or less zero.

This measure makes it possible, while maintaining the stability of the gripper, to achieve an extraordinarily favorable mass moment of inertia and, at the same time, to prevent undesired "shifting" of the gripper tip in relation to the gripper supports.

In an advantageous configuration, the gripper has a low-mass thin-walled sheet-metal housing. This makes it possible to keep the weight of the moving masses low. The sheet-metal housing has flexible, resiliently elastic regions, e.g. leaf springs, which allow resilient deflection of the gripper tip.

In an advantageous configuration, for the purpose of fastening the gripper tip on the gripper shaft, the low-mass sheet-metal housing is connected to the gripper shaft by a clamping component.

The configuration of the leaf springs constitutes a significant advantage of the invention.

A significant advantage of the configuration is that it cuts back considerably on the amount of installation space required, since the sheet-metal part can be formed around the gripper shaft, which is as stiff as possible. Furthermore, the gripper shaft may be dimensioned to be large enough for it also to be possible to arrange a torsion spring in the interior of the gripper shaft in order to generate restoring forces of known control rollers which are provided.

A further advantage of this configuration is that it is easy to adjust the parallelism of the gripper tip in relation to the gripper support. The sheet-metal housing is attached to the clamping component such that it has a degree of rotary freedom prior to being arrested definitively. This axis of rotation is disposed on the gripper tip—gripper shaft connecting line. As a result, when the housing is rotated in order to adjust the parallelism, the gripper center remains in the movement plane. A further special feature of this configuration is the low-mass formation of the sheet-metal housing with a simultaneously optimum configuration of the flexible and rigid regions which are necessary in respect of the rotary movement. The transition between these regions is realized here by way of straightforward bending edges, without any additional joints.

Other features which are considered as characteristic for the invention are set forth in the appended claims.

Although the invention is illustrated and described herein as embodied in a sheet-transporting apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
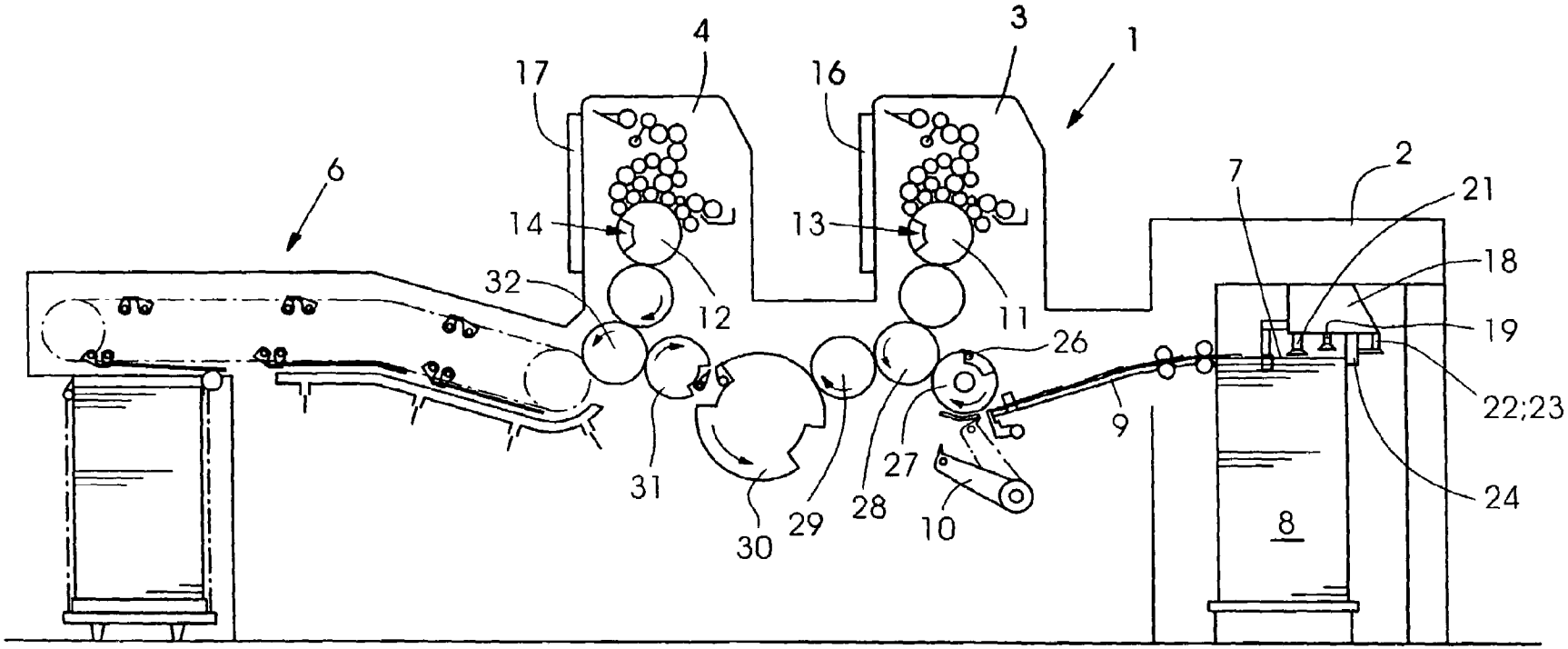
FIG. 1 is a diagrammatic, side-sectional view of a sheet-fed rotary printing machine according to the invention.
Figure 2:
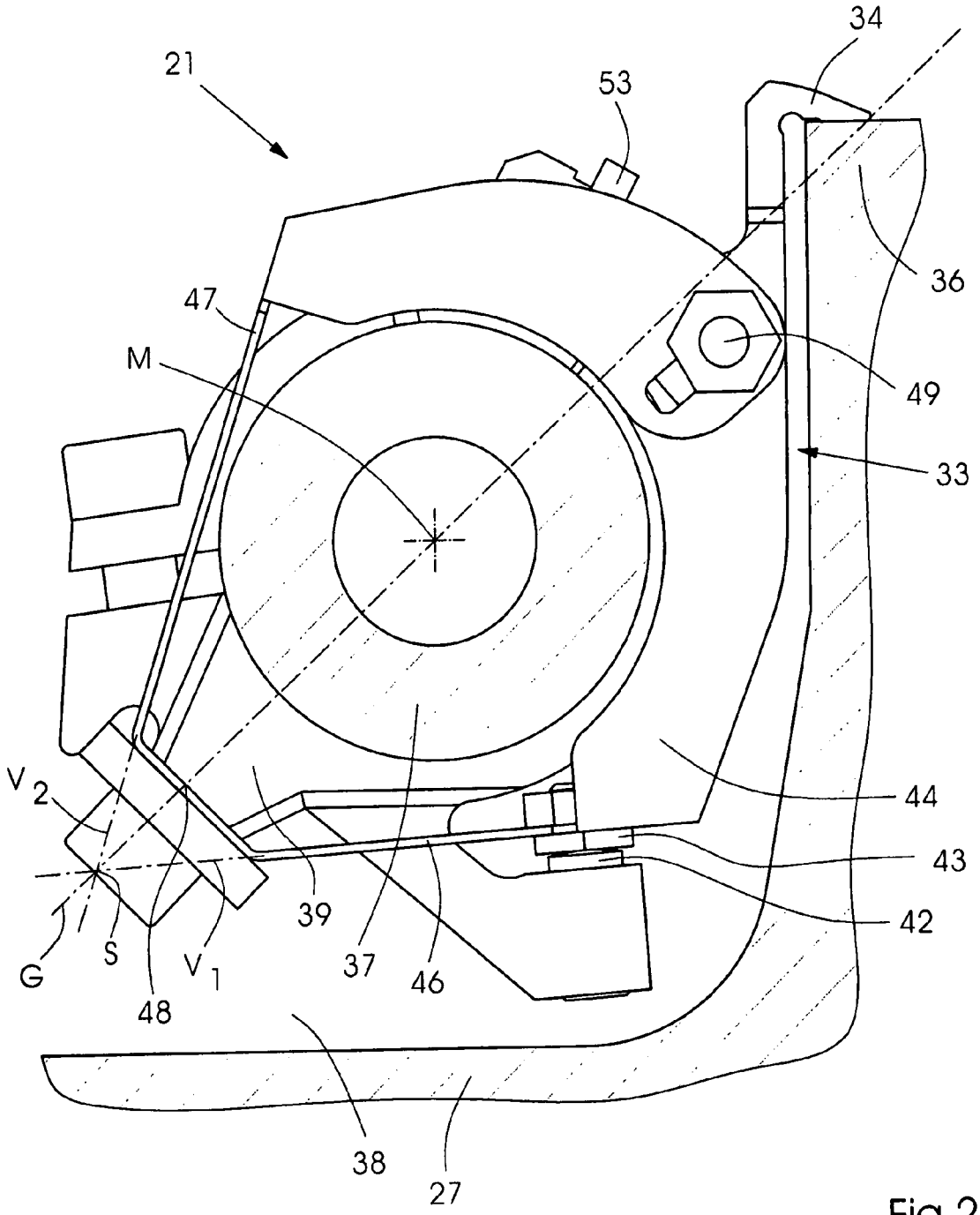
FIG. 2 is a side-sectional view of a gripper according to the invention.
Figure 3:
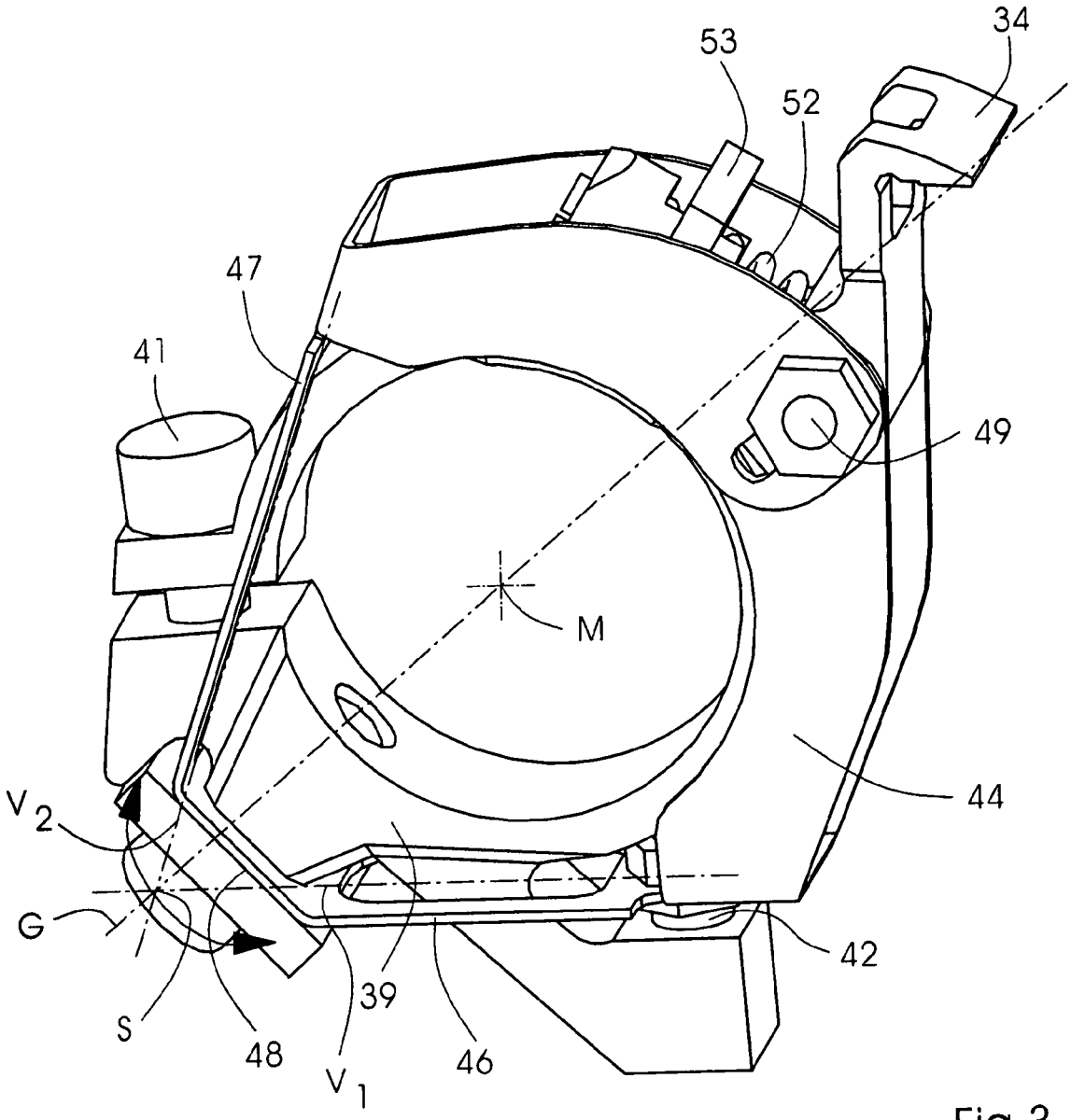
FIG. 3 is a perspective view of the gripper according to the invention.

Referring now to the figures of the drawing in detail and first, particularly, to FIG. 1 thereof, there is shown a machine 1 which processes sheets 7, e.g. a printing machine 1, that has a feeder 2, at least one printing unit 3, 4 and a delivery 6. The sheets 7 are removed from a sheet stack 8 and fed separately or in imbricated form to the printing units 3 and 4 via a feed table 9. The printing units 3, 4 each contain, in a known manner, a plate cylinder 11, 12. The plate cylinders 11 and 12 each have a configuration 13, 14 for fastening flexible printing plates. Furthermore, each plate cylinder 11, 12 is assigned a configuration 16, 17 for semi-automatic or fully automatic printing-plate changeover.

The sheet stack 8 rests on a stacking panel 10 which can be raised in a controlled manner. The sheets 7 are removed from the top side of the sheet stack 8 by a so-called suction head 18 which, inter alia, has a number of lifting and pull suckers 19, 21 for separating the sheets 7. Also provided are the blowing devices 22 for loosening the top sheet layers and follower elements 23 for stack adjustment. In order to align the sheet stack 8, in particular the top sheets 7 of the sheet stack 8, a number of lateral and rear stops 24 are provided.

A number of sheet-transporting cylinders 27 to 32 having gripper configurations 26 are provided for transporting the sheets 7 through the printing machine. The gripper configurations 26 each contain at least one gripper 33, which has a gripper tip 34 which interacts with a gripper support 36.

A number of grippers 33 are preferably spaced apart one beside the other on a common gripper shaft 37. The gripper shaft 37 is disposed in a channel 38 of the sheet-guiding cylinder, e.g. feed cylinder 27, such that it can be pivoted in a cam-controlled manner.

Each gripper 33 contains a clamping component 39 which encloses the gripper shaft 37 in the manner of a clamp and is screw-connected to the gripper shaft 37 by a fastening screw 41. A stop 42 is provided on the clamping component 39, and the stop 42 is disposed such that it can be brought to bear against an abutment 43 of a gripper housing 44.

The gripper housing 44 includes a metal housing which is thin-walled, e.g. approximately two millimeters in thickness, and encloses the gripper shaft 37 in a contact-free manner approximately over half its circumference. This is adjoined by two links 46, 47 in the form of flexible, resiliently elastic, thin-walled metal strips which are screwed onto the clamping component 39 at a common fastening location 48. When subjected to the action of force, the metal strips 46, 47 behave like leaf springs.

The fastening location 48 is positioned on an imaginary straight line G which passes through the fastening location 48, a center axis M of the gripper shaft 37 and the gripper tip 34. An imaginary extension $V_1$ of the leaf spring 46 and the imaginary extension $V_2$ of the leaf spring 47 intersect at a common point of intersection S on the straight line G.

According to the invention, the point of intersection S is positioned on a region of the straight line G which is located on the far side of the center axis M, as seen from the gripper tip 34.

The gripper tip 34 is seated on a bolt 49 which is disposed between two walls of the gripper housing 44. A strong compression spring 52 is supported on a stop 53 and, in the open state, pushes the gripper housing 44 against the first stop 42 of the clamping component 39.

In the closed state, the compression spring 52 pushes the gripper tip 34 against the gripper support 36, the stop 42 of the clamping component 39 here being spaced apart from the abutment 43 of the gripper housing 44.

I claim:

1. An apparatus for transporting sheets in a sheet-processing machine, the apparatus comprising:

a gripper support;

a gripper shaft;

a gripper pivotably mounted on said gripper shaft and having a gripper tip interacting with said gripper support; and two straight leaf spring sections adjoined to a gripper housing for articulating said gripper tip about said gripper shaft, said leaf spring sections being oriented such that respective straight imaginary extensions of said leaf spring sections intersect at a point on a straight line passing through said gripper tip and a center axis of said gripper shaft, said point being located on a far side of said center axis, as seen from said gripper tip.

2. The apparatus according to claim 1, wherein said gripper housing has a thin-walled construction and partially encloses said gripper shaft.

3. The apparatus according to claim 1, wherein said gripper further contains:

a clamping component having a stop and fastened to said gripper shaft;

a compression spring supported by said stop of said clamping component; and a bolt, said gripper tip of said gripper is disposed on said bolt and supported, by said compression spring.

* * * * *